US005725987A

United States Patent [19]

Combes et al.

[11] Patent Number: 5,725,987

[45] Date of Patent: Mar. 10, 1998

[54] SUPERCRITICAL PROCESSES

[75] Inventors: James R. Combes, Burlington; Hadi K. Mahabadi, Etobicoke; Carl P. Tripp, Burlington, all of Canada

[73] Assignee: Xerox Corporation, Stamford, Conn.

[21] Appl. No.: 740,680

[22] Filed: Nov. 1, 1996

[51] Int. Cl.[6] ..... G03G 9/08

[52] U.S. Cl. ..... 430/137; 430/110; 427/219; 427/226; 427/255.3

[58] Field of Search ..... 430/110, 137; 427/255.3, 226, 219

[56] References Cited

U.S. PATENT DOCUMENTS

| | | | |
|---|---|---|---|
| 4,652,509 | 3/1987 | Shirose et al. | 430/110 |
| 4,916,108 | 4/1990 | McLaughlin et al. | 502/337 |
| 5,312,882 | 5/1994 | DeSimone et al. | 526/201 |
| 5,514,512 | 5/1996 | Cunningham et al. | 430/137 |

*Primary Examiner*—Christopher D. Rodee
*Attorney, Agent, or Firm*—E. O. Palazzo

[57] ABSTRACT

A process which comprises heating at a temperature of from about 31° C. to about 200° C. a mixture of supercritical carbon dioxide, metal or metal oxide, and a surface treating component, optionally removing carbon dioxide, and optionally cooling.

25 Claims, No Drawings

SUPERCRITICAL PROCESSES

PENDING APPLICATIONS

Illustrated in U.S. Ser. No. 743,271, filed concurrently herewith, and the disclosure of which is totally incorporated herein by reference, is a process for the preparation of toner additives with liquid carbon dioxide.

BACKGROUND OF THE INVENTION

This invention is generally directed to a process for the preparation of additives, especially toner additives, and more specifically, the present invention relates to processes for obtaining surface treated metal or metal oxides. In embodiments, the present invention relates to the chemical treatment of metal or metal oxides in a supercritical fluid (SCF). The present invention relates in embodiments to the preparation of additives selected for toners, which toners are useful for the development of images in xerographic imaging and printing methods. In embodiments, the present invention more specifically relates to the preparation of toner surface additives wherein the additives are surface treated in a supercritical fluid, such as supercritical carbon dioxide. Accordingly, in embodiments of the present invention additives, such as silica and titania, are chemically surface treated and/or are treated by physical adsorption in supercritical carbon dioxide. This surface treatment can be achieved by using a surface treating reagent of, for example, an organosilane, including nitrogen containing silanes and halosilanes, and wherein after the surface treatment reaction is completed, the carbon dioxide can be quickly removed from the reaction vessel. Thus, with the processes of the present invention no or minimal solvent residue results and there are enabled additive products wherein no or minimal solvent waste exists. Moreover, a number of other advantages are achievable with the processes of the present invention, such as no, or minimal change in the resulting powder texture, or morphology of the surface treated additive obtained. The invention process in embodiments thereof can be considered a one step process and solvents, such as liquid hydrocarbons and halogenated solvents, and water believed selected for the prior art processes wherein additives are prepared are avoided. Also, there is enabled with the processes of the present invention complete and clean removal of the carbon dioxide solvent from the processed additive without costly and cumbersome solvent separation methods. Further, the use of a carbon dioxide medium eliminates the need for solvent disposal since, at atmospheric conditions, carbon dioxide spontaneously separates from solids, thus no liquid waste is generated. Also, some treating agents, or components, such as fluorosilanes, are more soluble in carbon dioxide as compared to their solubility in conventional liquid hydrocarbon solvents. One specific example of a potentially advantageous medium for the chemical surface treatment of these additives is supercritical fluid (SCF) carbon dioxide. As the critical temperature of $CO_2$ is about 31° C., a surface treating reagent dissolved in $CO_2$ above this temperature could potentially be in a SCF solution. One advantageous aspect of operation in this regime is that a continuous range of fluid densities can be profiled. Should the surface treatment proceed with an optimal solution density, a relatively simple pressure manipulation provides an opportunity to achieve this process condition. Another potential advantage of surface chemistry in SCF (supercritical fluid) carbon dioxide is that the kinetics of the particular surface treatment reaction may be enhanced at temperatures of 35° C. and higher. Since an operating temperature of approximately 31° C. or higher could render the solution into the SCF regime, operation of the process is more economically viable than operation in the liquid phase of carbon dioxide or in conventional liquids. What primarily distinguishes a supercritical fluid from a vapor is that no meniscus can be discerned in the fluid phase regardless of the pressure applied.

The use of supercritical carbon dioxide for the synthesis of polymers by a certain process is illustrated in U.S. Pat. No. 5,312,882, the disclosure of which is totally incorporated herein by reference.

A number of additives for toners are known, such as fumed silicas, metals, metal oxides and the like. These materials, which can be selected as toner additives, especially toner surface external additives, are usually in the form of fine powders with primary particle sizes in the range of from about 5 to about 500 nanometers. Specific examples of toner surface additives are silicon dioxides, and titanium dioxides. Their presence on toner surfaces aids in toner triboelectric charging while maintaining the needed toner flow characteristics. Many of the toner surface additive particulate oxides, such as titania and silica, in the untreated form contain surface hydroxyl groups which render the material hydrophilic. A hydrophobic external additive is usually necessary to yield a toner with the desired charging and humidity sensitivity characteristics. Surface treatment of these oxides is, therefore, utilized to cap the surface hydroxyl groups with a nonpolar species, thereby rendering the material hydrophobic and more suitable for use as a toner additive. Two conventional processes for toner additive surface treatment to generate surface treated metals and metal oxides include a gas phase treatment and a conventional noncarbon dioxide liquid solution treatment. In the gas phase treatment, the additive to be treated is contacted with the surface treating reagent of, for example, organosilanes such as dichlorodimethylsilane (DCDMS), hexamethyldisilazane (HMDS) or chlorotrimethylsilane in the effluent of a furnace in which the oxide was formed. This effluent stream is composed of the metal entrained in a gaseous stream of air, water and other reactants, and reaction byproducts like silicon tetrachloride, hydrochloric acid, and alcohols, such as methanol. Since the reaction temperatures are relatively high (~400° C.), the reaction between the surface treating reagent and the surface proceeds quickly, in a manner of 0.01 to 0.1 minutes. However, this process (as outlined in Langmuir 1995, 11, 1858.) is limited to volatile reagents and can be slowed by mass transport limitations. Even at relatively high furnace effluent temperatures, many commonly used surface treating reagents, for example octadecyltrichlorosilane (OTS), are unsuitable because of their involatibility, thus they are unable to transport to and react with the surface of the metal or metal oxide. An additional difficulty with gas phase treatment processes is their inability to efficiently undergo process changes. Therefore, a limited range of surface treated, hydrophobic metal oxides is available for use with this methodology.

In existing liquid solution treatment processes, conventional liquid solutions employing solvents, such as methylene chloride, carbon tetrachloride or toluene, are selected (Langmuir 1992, 8, 1120). While these solvents facilitate transport of the surface treating reagent to the metal oxide, the solvent is eventually separated from the treated oxide product. Therefore, costly and difficult solvent separation steps are needed. An additional difficulty with conventional liquid solution processes is that the solution containing the dispersed oxide can become viscous, retarding the kinetics somewhat, thereby resulting in long reaction times. Liquid solutions also present certain health and safety problems in handling and storage. Even after removal of the solvent from the solid product, the texture and morphology of the oxide powder can be adversely altered. Moreover, agglomeration of the oxide powder arising from contact with the liquid can dramatically increase the particle size and the particle size distribution. Therefore, additional grinding and processing equipment is required to provide the material in a free flowing, powdered form amenable to its proper dispersion on toner surfaces.

Therefore, a need exists for a surface treatment process for metals, metal oxide powders, and the like in which no solvent separation or purification procedures are required. An additional need resides in processes for the elimination of toxic and/or flammable liquid solvents. Another need is for the avoidance of powder agglomeration or coagulation subsequent to surface treatment. These and other needs and advantages are believed achievable with the processes of the present invention, and more specifically, with supercritical fluid carbon dioxide, which is nontoxic and nonflammable, separates completely and spontaneously from suspended solids, and yields little or no solid coagulum subsequent to treatment, a number of advantages are obtainable.

SUMMARY OF THE INVENTION

Examples of objects of the present invention include:

it is an object of the present invention to provide additives and processes thereof with many of the advantages illustrated herein.

In another object of the present invention there are provided chemical treatment processes for generating toner surface additives.

In yet another object of the present invention there are provided supercritical fluid carbon dioxide based processes for the preparation of toner surface additives.

Moreover, in another object of the present invention there are provided economical and substantially waste free processes for the preparation of toner surface additives.

Further, in another object of the present invention there are provided processes for the preparation of toner surface additives wherein conventional liquid solvents and, more specifically, halogenated solvents are avoided.

Another object of the present invention resides in improved processes for the preparation of toner surface additives and toner and developers thereof, and more specifically, one step processes that do not require costly and elaborate solvent separation methodologies.

Moreover, in another object of the present invention there are provided processes with supercritical carbon dioxide for the preparation of surface additives wherein mass transport limitations are avoided or minimized since the carbon dioxide possesses in embodiments a viscosity of from one to two orders of magnitude lower than the prior art conventional liquid solvent based processes.

Also, in another object of the present invention there are provided positively charged toner compositions, or negatively charged toner compositions having admixed therewith carrier particles with a coating thereover.

In embodiments there are provided processes for the preparation of additives, and more specifically, processes for the preparation of toner surface additives wherein supercritical fluids, such as supercritical fluid carbon dioxide, or supercritical carbon dioxide, are selected. Also, in embodiments there can be selected for the preparation of toner surface additives liquid carbon dioxide.

Embodiments of the present invention relate to processes which comprise heating a mixture of the component to be surface treated, such as an oxide powder and supercritical carbon dioxide, which heating is, for example, accomplished at a temperature of from about 31 to about 200, and preferably from about 50° to about 70° C., maintaining the temperature for an effective time, for example from about 5 to about 60 minutes; adding with, for example, a high pressure pump the surface treating agent, such as hexamethyldisilazane; heating for a further effective time of, for example, from about 10 to about 240 minutes; removing the carbon dioxide by, for example, depressurizing and cooling the reactor to about room temperature by removing the heat source, and wherein the removed carbon dioxide, which may contain impurities, is isolated and potentially reused.

Specific embodiments of the present invention include the desired amount, for example from 1 to 100 w/V percent, 1 to 100 grams per 100 milliliters of reactor volume, of the component to be treated, such as a metal or metal oxide, is weighed and placed in a high pressure reactor. The reactor is then sealed and either evacuated or purged with an inert atmosphere (e.g. $N_2$ or Ar). The primary purpose of the purging is to remove from about 95 percent to about 99 percent of atmospheric water from the reactor. The reactor is then brought up to the desired temperature for the reaction, which with SCF $CO_2$ is in the range of from about 31° C. to 200° C. Many of the surface reactions can proceed readily at relatively low temperatures (~40° C.). The higher temperatures near 200° C. might present kinetic advantages, and such temperatures are needed for the reaction of certain reagants with the additive surface. The carbon dioxide is then introduced into the vessel via a high pressure pump or compressor. Sufficient carbon dioxide to yield an overall fluid density of a range of about 0.7 to about 1.8 g/cc is introduced. Depending on the temperature chosen, the generated pressure that results from this density can range from about 80 to about 700 bar. Agitation of the resulting dispersion of the oxide in $CO_2$ is then commenced with an impeller at a rotational speed of from about 1 to about 200 rpm, with the preferred speed being from about 10 to about 50 rpm. Gentle agitation (10 to 50 rpm for the duration of the reaction) is generally employed to minimize, or avoid erosive wear of the oxide against the metal surfaces of the reactor. After agitation has commenced, a surface treating reagent, generally an organosilane but potentially any species that reacts with an alcohol such as an organic isocyanate, carboxylic acid or ester, metal or organic alkoxide, and the like is introduced into the SCF solution via a high pressure pump. The operating pressure range for this addition is from about 80 to about 700 bar, with the preferred range being from about 130 to about 200 bar. Organosilanes are typically used to treat the oxides as they are known to react with surface OH groups to yield a metal or semiconductor atom (surface)-oxygen-silicon treated surface. Reaction byproducts diffuse from the surface and are dissolved in the fluid $CO_2$ solution. The reactor is then maintained at the desired temperature and pressure for from about 5 to 250 minutes. Subsequently, the reactor is slowly depressurized (over a 30 minute time period) via throttling a valve until the pressure inside the reactor reaches atmospheric pressure, about 1 bar. An inert atmosphere of, for example, argon is then introduced into the reactor to prevent any atmospheric moisture from being introduced into the system. The reactor is then cooled to below 30° C., and more specifically, to about 25° C., primarily to aid in handling and removal of the treated solid product.

Examples of oxides that can be selected for the processes of the present invention include, but are not limited to, iron oxides, zinc oxides, aluminum oxides, copper oxides, silicon and titanium oxides, calcium oxides, magnesium oxide, mixtures thereof, and the like. Examples of metals that may be selected include aluminum, zinc, chromium, iron, titanium, magnesium, copper, tin, and the like. The particle sizes of the component to be treated, especially the oxides, range, for example, in size diameter of from about 5 to about 500 nanometers.

Surface treating or coating components include, but are not limited to, organosilanes including alkyl with, for example, from 1 to about 25 carbon atoms, such as octadecyltrichlorosilane or decyltrimethoxysilane, aryl with, for example, from 6 to about 30 carbon atoms, such as triphenylchlorosilane, and fluoralkyl, such as (tridecafluoro-1,1,2,2-tetrahydrooctyl)-1-trichlorosilane or (3,3,3-trifluoropropyl)trichlorosilane, organosilanes. Haloalkylsilanes, such as dichlorodimethylsilane, can also be selected. Other treating reagents are alkoxysilanes, organic isocyanates, carboxylic acids or esters and metal alkoxides, and the silanes of U.S. Pat. No. 5,376,172, the disclosure of which is totally incorporated herein by reference. Products obtained include hydrophobic silica, hydrophobic titania, oxides, and the like.

Embodiments of the present invention include a process which comprises heating at a temperature of from about 31° C. to about 200° C. a mixture of supercritical carbon dioxide, metal or metal oxide, and a surface treating component, optionally removing carbon dioxide, and optionally cooling; a process for the preparation of toner additives comprised of a core of a metal oxide or a metal, and which process comprises a first heating at a temperature at from about 31° to about 200° C. of a mixture of carbon dioxide, and metal or metal oxide, adding a surface treating component to the mixture, and which component reacts with or is physically adsorbed upon the surface of the metal or metal oxide, and maintaining the temperature of from about 31° C. to about 200° C., removing carbon dioxide, and cooling; a process wherein the metal is selected from the group consisting of aluminum, zinc, chromium, iron, titanium, magnesium, copper, and tin; a process wherein the metal oxide is selected from the group consisting of aluminum oxide, titanium dioxide, silicon dioxide, magnetite, zinc oxide, copper oxide, and magnesium; a process wherein the surface treating component reacts with the surface of the metal or metal oxide; a process wherein the mass ratio amount of carbon dioxide to metal, or metal oxide, is about 20:5, or about 15:2; a process wherein there is selected from about 0.5 to about 70 weight percent of treating agent based on the amount of metal or metal oxide; a process wherein there is obtained a toner additive of a size diameter of from about 5 to about 500 nanometers; a process wherein a closed reactor vessel is selected, the temperature in the reactor is maintained at from about 80 to about 150° C., and the pressure in the reactor is from about 20 to about 300 bar; a process wherein the pressure in the reactor is from about 30 to about 50 bar; wherein the reactor contents are stirred with a device operating at a speed of from about 1 to about 200 revolutions per minute, and wherein the reactor is depressurized, and wherein subsequent to depressurization, the product is removed; a process wherein the surface treating reagent is an organosilane, an organic isocyanate, a carboxylic acid or ester thereof, metal alkoxide, or organic alkoxide; and a process wherein the amount of metal or metal oxide is from about 1 to 300 w/V percent, or about 1 to about 300 grams of additive for every 100 milliliters of reactor volume.

The surface additives obtained with the processes of the present invention and comprised, for example, of silicon oxides with a layer thereover of the treating component, such as hexamethyldisilazane, can be selected for toner compositions, and wherein there are present resin, especially thermoplastic resin, and pigment. Illustrative examples of finely divided toner resins selected for the toner include known thermoplastics, such as polyamides, epoxies, polyurethanes, diolefins, vinyl resins and polymeric esterification products of a dicarboxylic acid and a diol comprising a diphenol, and extruded polyesters as illustrated in U.S. Pat. No. 5,376,494, the disclosure of which is totally incorporated herein by reference. Specific vinyl monomers that can be used are styrene, p-chlorostyrene, vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, and the like. Also, styrene butadiene copolymers, mixtures thereof, and other similar known thermoplastic toner resins can be selected.

As one toner resin there can be selected the esterification products of a dicarboxylic acid and a diol comprising a diphenol, reference U.S. Pat. No. 3,590,000, the disclosure of which is totally incorporated herein by reference. Other toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol.

Numerous well known suitable pigments or dyes can be selected as the colorant for the toner including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20, and preferably from about 4 to about 10 percent by weight, based on the total weight of the toner composition.

When the pigment particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin is present in a sufficient, but effective amount, thus when 10 percent by weight of pigment, or colorant such as carbon black is contained therein, about 90 percent by weight of resin material is selected. Generally, the toner composition is comprised of from about 85 percent to about 97 percent by weight of toner resin particles, from about 3 percent by weight to about 15 percent by weight of pigment particles, such as carbon black, and the surface treated additives in effective amounts of, for example, from about 0.05 to about 10, and from about 1 to about 2 weight percent.

Pigments or colorants of magenta, cyan and/or yellow particles, as well as mixtures thereof can also be selected. More specifically, illustrative examples of magenta materials that may be selected as pigments include 1,9-dimethylsubstituted quinacridone and anthraquinone dye identified in the Color Index as CI 60720, CI Dispersed Red 15, a diazo dye identified in the Color Index as CI 26050, CI Solvent Red 19, and the like. Examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide, phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the toner compositions, and as optional components there can be incorporated herein charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate, and other known charge additives, including negative charge additives, such as BONTRON E-88®, TRH, and similar aluminum complexes. These additives are usually incorporated into the toner in an amount of from about 0.1 percent by weight to about 20 percent by weight.

The toner composition with an average volume size diameter of from about 5 to about 20 microns can be prepared by a number of known methods including melt blending the toner resin particles, and pigment particles or colorants of the present invention, followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Thereafter, there is added to the toner the additives obtainable with the processes of the present invention and which additives are selected in various effective amounts, such as for example from about 0.05 to about 3, and preferably from about 0.9 to about 2 weight percent.

Also, the toner and developer compositions, that is toner and carrier, may be selected for use in electrostatographic imaging and printing processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines, vanadyl phthalocyanines, titanyl phthalocyanines, bisperylenes, gallium phthalocyanines, and the like. As charge transport molecules there can be selected the aryl diamines disclosed in the '990 patent. Moreover, the developer compositions are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference; and such developers can be selected for digital imaging apparatuses, such as the Xerox Corporation DOCUTECH™.

Images obtained with the toner and developer compositions illustrated herein will, it is believed, possess acceptable solids, excellent halftones and desirable line resolution with acceptable or substantially no background deposits.

The following Examples are being provided to further illustrate the present invention, it being noted that these Examples are intended to illustrate and not limit the scope of the present invention. Parts and percentages are by weight unless otherwise indicated.

EXAMPLE I

Two grams of untreated silica with a surface area of approximately 50 $m^2$/gram, or about 30 to 40 nanometers in size diameter, obtained from Degussa Chemicals as OX-50, were placed in a 25 millimeter high pressure cell equipped with sapphire windows. The cell was subsequently sealed. The inert gas, argon, was then purged for 20 minutes through the cell to remove atmospheric gases. The cell was then heated to 70° C. and then filled with a solution of 0.26 millimeter of hexamethyldisilazane (10 weight percent relative to the untreated silica OX-50) in 15 grams of carbon dioxide (bone-dry grade, Praxair), which changes to supercritical carbon dioxide after being added to the 70° C. cell via a variable volume syringe pump. The resultant pressure in the cell from this injection was 190 bar psia. The reactor was maintained at these conditions for 30 minutes. After this duration, the pressure was vented and the cell was allowed to cool thereby bringing the cell and the treated silica contents to atmospheric conditions and room temperature, about 25° C.. The treated silica contents were then removed for vacuum treatment and spectroscopic characterization.

For spectroscopic characterization, a small amount (500 milligrams) of the treated silica was placed on a disk of cesium iodide and uniformly smeared over the disk using a glass plate. The disk with the film of treated silica was then placed in an infrared beam of a Bomem Model 102 FTIR spectrometer for characterization. The resultant silica spectrum revealed a complete removal of the "free OH" band at 3,747 $cm^{-1}$ and the presence of hydrocarbon vibrations around 2,900 $cm^{-1}$.

The product resulting was thus comprised of a silicon dioxide with a uniform trimethylsilyl coating thereover.

EXAMPLE II

The process of Example I was repeated with octadecyltrichlorosilane in place of hexamethyldisilazane, and with substantially similar results.

Spectroscopic characterization was similar as Example I, however, a substantially stronger hydrocarbon absorption band was apparent primarily because of the greater number of $CH_2$ groups with octadecyltrichlorosilane attached either via physical adsorption or surface reaction to the silicon oxide core.

The product was comprised of a silicon dioxide core with a uniform coating of octadecylsilyl thereover.

EXAMPLE III

The process of Example I was repeated with dichlorodimethylsilane instead of hexamethyldisilazane, and with substantially similar results.

The product was comprised of a silicon dioxide with a uniform coating or thin layer of dimethylsilyl coating thereover.

EXAMPLE IV

The process of Example I was repeated with a silica of 400 $m^2$/gram, and substantially similar results were achieved.

The product was thus comprised of a silicon dioxide of 400 $m^2$/gram with a trimethylsilyl coating thereover.

EXAMPLE V

The process of Example I was repeated with titanium dioxide of a size of 50 $m^2$/gram instead of silica.

The product was comprised of a titanium dioxide of 50 $m^2$/gram with a trimethylsilyl coating thereover.

EXAMPLE VI

The process of Example I was repeated with 20 weight percent of decyltrimethoxysilane instead of hexamethyldisilazane.

The product was comprised of a silicon dioxide with a decylsilyl coating thereover.

EXAMPLE VII

The process of Example V was repeated with titanium dioxide of a size of 400 $m^2$/gram.

The product was comprised of a titanium dioxide of 400 $m^2$/gram with a trimethylsilyl coating thereover.

EXAMPLE VIII

The process of Example I was repeated for a duration of 240 minutes instead of 30 minutes, and substantially similar results were achieved.

The product was comprised of a silicon dioxide with a trimethylsilyl coating thereover.

EXAMPLE IX

The process of Example I was repeated, but with an operating temperature of 150° C. instead of 70° C., and substantially similar results were achieved.

The product was comprised of a silicon dioxide with a trimethylsilyl coating thereover.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for the preparation of a toner composition which comprises heating at a temperature of from about 31° C. to about 200° C. a mixture of supercritical carbon dioxide, metal oxide, and a surface treating component, optionally removing carbon dioxide, and optionally cooling, and wherein said surface treating component reacts with the surface of the metal oxide, thereafter adding the resultant treated metal oxide to a toner comprising resin and colorant.

2. A process in accordance with claim 1 wherein the surface treating components reacts with the surface of the metal oxide.

3. A process in accordance with claim 1 wherein a closed reactor vessel is selected, the temperature in the reactor is maintained at from about 80° to about 150° C., and the pressure in the reactor is from about 20 to about 300 bar.

4. A process in accordance with claim 3 wherein the pressure in the reactor is from about 30 to about 50 bar.

5. A process in accordance with claim 3 wherein the reactor contents are stirred with a device operating at a speed of from about 1 to about 200 revolutions per minute, and wherein the reactor is depressurized, and wherein subsequent to depressurization the product is removed.

6. A process in accordance with claim 3 wherein the amount of metal oxide is from about 1 to 300 w/V percent, or about 1 to about 300 grams of toner additive for every 100 milliliters of reactor volume.

7. A process in accordance with claim 3 wherein the reactor is purged with argon or nitrogen, wherein carbon dioxide is added in an amount sufficient to generate a fluid density of from 0.7 to 1.8 grams/cc, and the surface treating reagent is added in a range of from 0.5 to 70 weight percent, relative to the metal or metal oxide mass.

8. A process in accordance with claim 1 wherein the metal oxide is fumed silica.

9. A process in accordance with claim 1 wherein the metal oxide is titanium dioxide.

10. A process in accordance with claim 1 wherein the surface treating reagent is an organosilane, an organic isocyanate, a carboxylic acid or ester thereof, metal alkoxide, or organic alkoxide.

11. A process in accordance with claim 1 wherein metal oxide the product obtained is comprised of a metal oxide core with a hydrophobic surface.

12. A process in accordance with claim 1 wherein the product obtained is comprised of a metal or metal oxide core with a coating of the reaction product of said surface treating reagent on the core surface.

13. A process in accordance with claim 1 wherein cooling is accomplished.

14. A process in accordance with claim 1 wherein heating is accomplished at a temperature of from about 80° to about 150° C., the pressure is from about 30 to about 1,000 bar, and the surface treating component is reacted with or physically adsorbed upon the surface of metal oxide, and wherein the mixing and heating are accomplished in a closed reactor.

15. A process for the preparation of a toner composition which process comprises a first heating at a temperature of from about 31° C. to about 200° C. of a mixture of carbon dioxide, and a metal oxide, adding a surface treating component to the mixture and which component reacts with the surface of the metal oxide, and maintaining the temperature at from about 31° C. to about 200° C., removing carbon dioxide, and cooling, thereafter adding the resultant treated metal oxide to toner comprising resin and colorant.

16. A process in accordance with claim 15 wherein subsequent to adding a surface treating component to the mixture the temperature is maintained for a period of time of from about 5 to about 240 minutes.

17. A process in accordance with claim 15 wherein the first heating is for a period of from about 10 to about 60 minutes.

18. A process in accordance with claim 15 wherein the metal oxide is selected from the group consisting of aluminum oxide, titanium dioxide, silicon dioxide, magnetite, zinc oxide, copper oxide, and magnesium oxide.

19. A process in accordance with claim 15 wherein the surface treating agent is an organosilane.

20. A process in accordance with claim 15 wherein the treating agent is selected from the group consisting of hexmethyldisilazane, dichlorodimethylsilane, and decyltrimethoxysilane.

21. A process in accordance with claim 15 wherein the surface treating agent is octadecyltrichlorosilane.

22. A process in accordance with claim 15 wherein the mass ratio amount of carbon dioxide to metal oxide is about 20:5.

23. A process in accordance with claim 15 wherein there is selected from about 0.5 to about 70 weight percent of treating agent based on the amount of metal oxide.

24. A process in accordance with claim 15 wherein there is obtained a treated metal oxide of a size diameter of from about 5 to about 500 nanometers.

25. A process for the preparation of a toner composition which process consists essentially of a first heating at a temperature of from about 31° C. to about 200° C. of a mixture of carbon dioxide, and metal oxide, adding a surface treating component to the mixture and which component reacts with or is physically adsorbed upon the surface of the metal oxide, and maintaining the temperature at from about 31° C. to about 200° C., removing carbon dioxide, and cooling, thereafter adding the resultant treated metal oxide to toner comprising resin and colorant.

* * * * *